United States Patent [19]

Kasper

[11] 4,039,794

[45] Aug. 2, 1977

[54] APPARATUS AND METHOD FOR HEATING FERROMAGNETIC ABRASIVE SHOT

[75] Inventor: Robert J. Kasper, Seven Hills, Ohio

[73] Assignee: Park-Ohio Industries, Inc., Cleveland, Ohio

[21] Appl. No.: 648,960

[22] Filed: Jan. 14, 1976

[51] Int. Cl.[2] ..... H05B 5/02

[52] U.S. Cl. ..... 219/10.49; 148/150; 219/10.65; 219/10.61; 219/10.71; 266/252; 432/82; 219/10.41

[58] Field of Search ..... 219/10.49, 10.79, 10.57, 219/10.71, 10.67, 10.69, 10.73, 10.65, 10.51, 10.41, 10.43, 7.5, 6.5, 10.75; 266/252, 254, 255, 257; 148/150, 153, 154, 155; 432/82; 165/66

[56] References Cited

U.S. PATENT DOCUMENTS

| | | | |
|---|---|---|---|
| 1,975,437 | 10/1934 | Sorrel | 219/10.49 |
| 2,408,190 | 9/1946 | Baker | 219/10.41 |
| 2,513,778 | 7/1950 | Bailey | 219/10.49 |
| 3,039,753 | 6/1962 | Eketord et al. | 432/82 |
| 3,150,224 | 9/1964 | Libman | 266/252 |
| 3,180,917 | 4/1965 | Morrison et al. | 219/10.49 |
| 3,318,591 | 5/1967 | Holcroft | 266/252 |
| 3,362,857 | 1/1968 | Stewart | 266/252 |

*Primary Examiner*—Bruce A. Reynolds
*Attorney, Agent, or Firm*—Meyer, Tilberry & Body

[57] ABSTRACT

There is provided an apparatus and method for heating ferromagnetic abrasive shot to a selected temperature substantially above the Curie Point temperature of the metal forming the shot. An elongated generally cylindrical retort, having a central axis and a central passage and being formed from a magnetically permeable material having a Curie Point temperature, is divided into first and second axially spaced heating zones. Each zone is surrounded by a generally cylindrical surface portion of the central passage. A first inductor means is used for inductively heating the generally cylindrical surface portion of the first zone to a temperature below the Curie Point temperature of the retort material so that a major portion of the magnetic flux from the first inductor means is concentrated in the metal forming the retort. A second inductor means is used for inductively heating the generally cylindrical surface portion of the second zone to a temperature substantially above the Curie Point temperature of the retort material whereby a major portion of the flux from the second inductor means extends through the metal of the retort and into the central passage. The shot is conveyed through the retort as the retort is being rotated for first heating the shot to a temperature below the Curie Point temperature of the shot and then to a temperature above the Curie Point of the shot.

15 Claims, 5 Drawing Figures

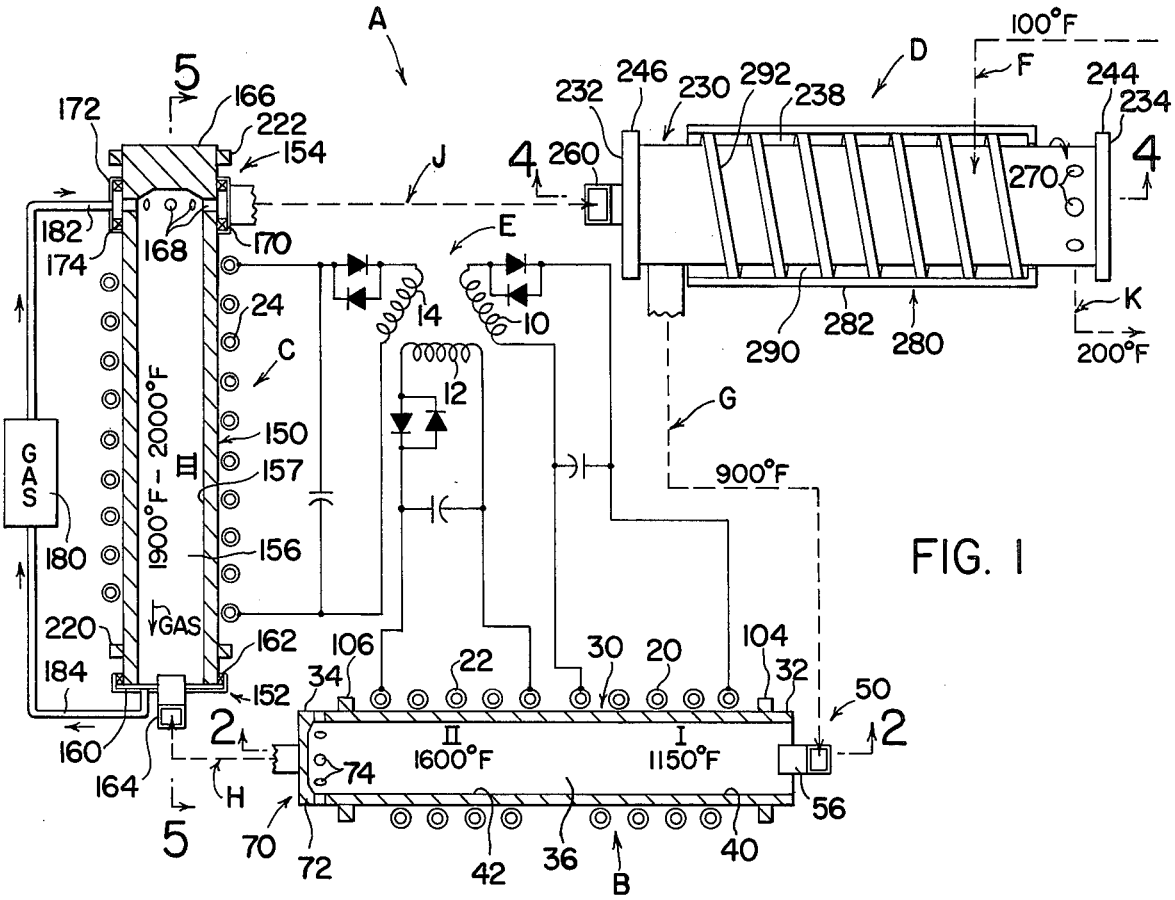
FIG. 1
FIG. 2
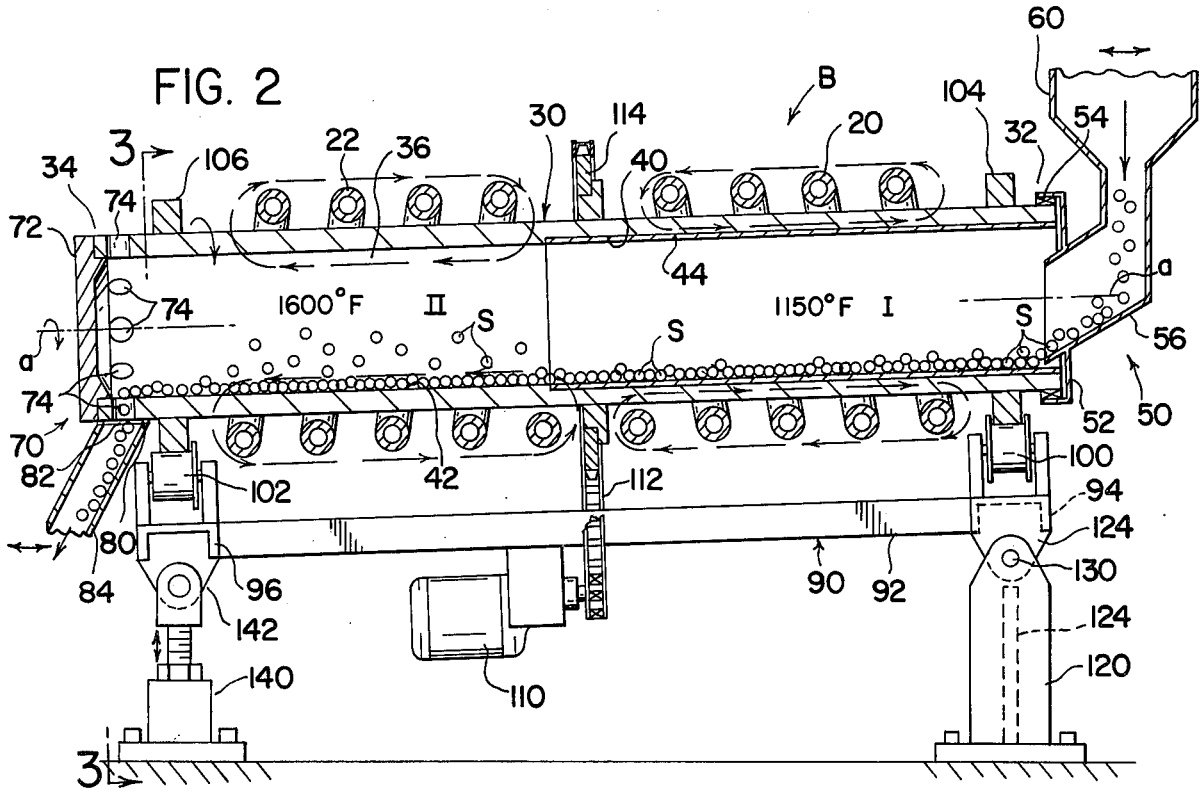

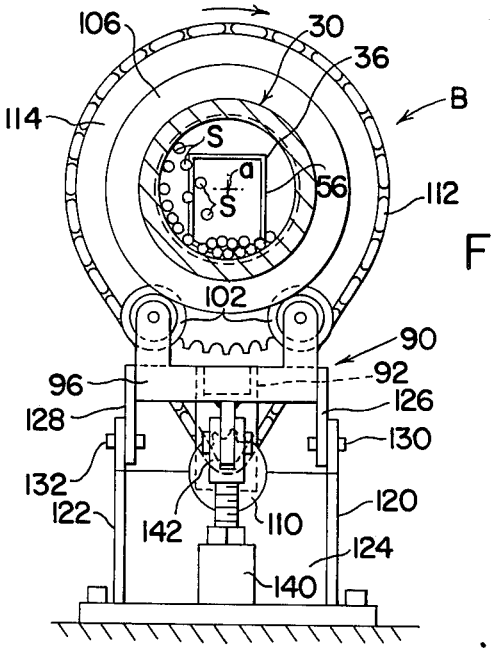
FIG. 3
FIG. 4
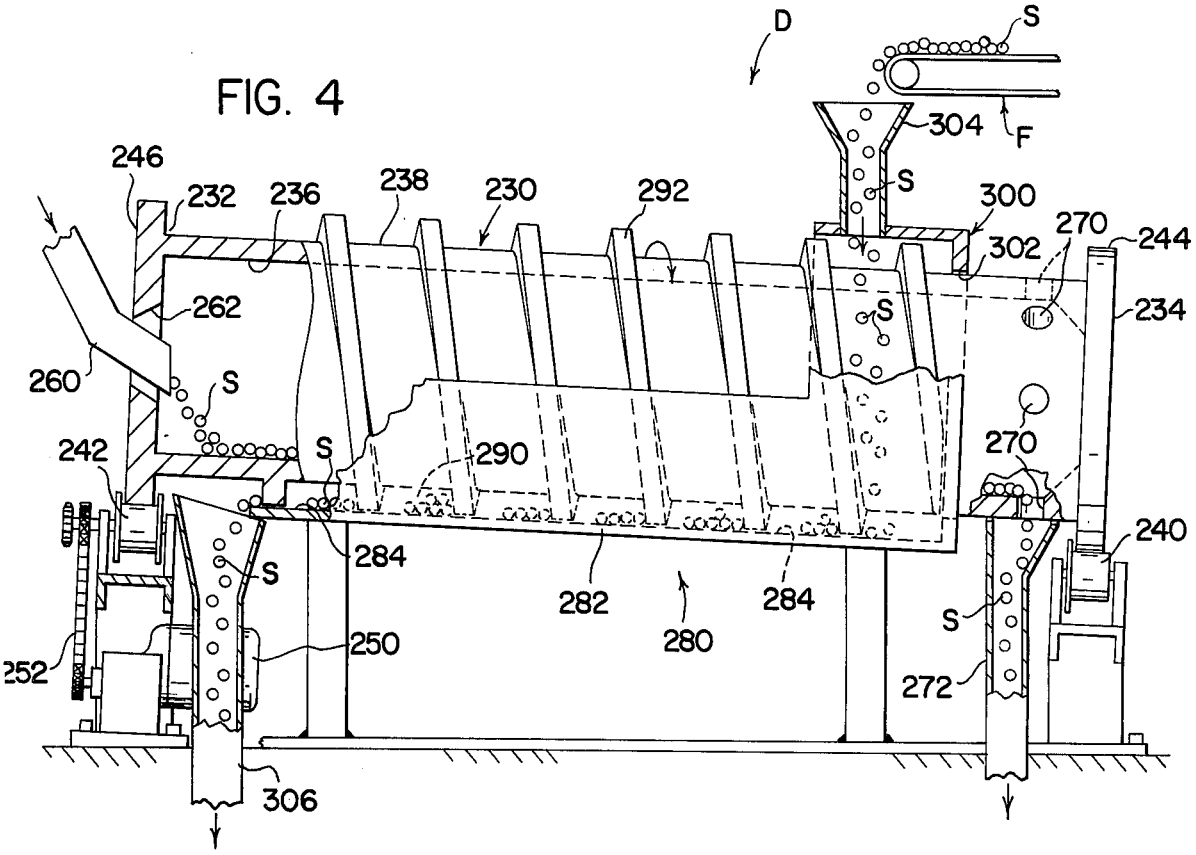

APPARATUS AND METHOD FOR HEATING FERROMAGNETIC ABRASIVE SHOT

This invention relates to the art of processing ferromagnetic shot and more particularly to an improved method and apparatus for heating ferromagnetic shot by using induction heating techniques.

The invention is particularly applicable for ferromagnetic shot used as a metal abrasive for cleaning metal castings, forgings and similar items preparatory to decarburizing the shot, and it will be described with particular reference thereto; however, it is appreciated that it has broader application and may be used in various processes requiring the heating of ferromagnetic shot.

As is well known, metal abrasives or shot are small, usually globular particles of chilled iron, malleable iron or steel which are propelled at high velocity against a casting or other item to be cleaned. These particles have a general size of about one-sixteenth inch and are usually in the general range of one-eighth to one-thirty-second inch across their major dimension. The term shot herein shall also include abrasive grit which is particulated particles of iron or steel used for abrasive purposes and having jagged edges. Grit is usually produced by milling globular abrasive particles into smaller particles. Consequently, the term "shot" as herein used is the generic term for all particulated metal particles used for abrasive shot blasing, although the globular particles are generally processed.

Metal abrasive or shot is now generally decarburized to increase its life without substantially decreasing its effectiveness as an abrasive. A variety of processes have been developed for this purpose. All of these prior processes involve heating of the shot to an elevated temperature in the general range of 1700°-2000° F and then subjecting the heated shot to carbon dioxide, nitrogen, hydrogen or other decarburizing atmospheres. In the past, these processes have involved conveying the shot through a heating zone containing the decarburizing atmosphere. These heating zones have been heated by gas-fired furnaces which consume a large amount of natural gas, which is in short supply and becoming increasingly more expensive. In addition, gas-fired furnaces require a substantial amount of insulating to prevent the escape of heat from the heating zone. The disadvantages of using gas-fired furnaces for decarburizing abrasive shot could be overcome by using induction heating, which does not require natural gas, does not generate exhaust byproducts, does not require a large space and does not require substantial insulation. However, the problems of induction heating of particles in the general range of one-sixteenth inch across their major dimensions has heretofore prevented serious consideration of induction heating for the well known metallic abrasives or shot. As is well known, induction heating requires circulation of electrical currents within the part being heated, which is difficult when the heated media is a small particle i.e. generally less than a reference depth in diameter for a given heating frequency. In addition, a small magnetic particle tends to be propelled by the magnetic flux used in induction heating. Such propelling or magnetomotive action prevents orderly progress of small particles through an induction furnace. In view of these obvious disadvantages of attempting to use induction heating for metallic abrasives or shot, induction heating has not heretofore been used commercially for heating metal abrasive particles.

The present invention relates to an induction heating installation which can process metal abrasives, such as abrasive shot, to obtain the advantages of induction heating, while overcoming the disadvantages presented by the small size of the shot being processed.

In accordance with the present invention, there is provided an apparatus for heating ferromagnetic shot to a selected temperature substantially above the Curie Point temperature of the metal forming the shot. This apparatus comprises an elongated, generally cylindrical retort, at least an axial part of which is ferromagnetic, having a central axis, and a central passage. The retort is divided into first and second axially spaced heating zones, with each of the heating zones being surrounded by first and second generally cylindrical surface portions, respectively. A first inductor means is used for inductively heating the first generally cylindrical surface portion to a temperature below the Curie Point temperature of the shot and a major portion of the magnetic flux from the first inductor means is concentrated in a magnetic wall of the retort itself. A second inductor means is used for inductively heating the second generally cylindrical surface portion to a temperature substantially above the Curie Point temperature of the shot whereby a major portion of the flux from the second inductor means extends through the retort into the central passage. Finally, there is provided a means for conveying the shot successively through the first and second heating zones and means for rotating the retort with respect to the first and second inductor means.

By using the apparatus as defined above, the retort itself is inductively heated by stationary inductor means while it is being rotated. Heat is conducted and radiated to the shot from the internal cylindrical surfaces of the retort itself. A low frequency power supply, such as 60 hertz, can be used for the induction heating operation. In the first heating zone the inner surface of the retort is not heated to its non-magnetic condition and flux is, thus, concentrated in the magnetic wall of the retort itself. Thus, the flux from the first inductor means does not extend into the central passage of the retort, which action would create ferromagnetic forces on the shot to propel the shot from the retort. As the shot is heated through its Curie Point temperature in the second heating zone, the retort itself is above the Curie Point temperature of the magnetic retort material when the material is magnetic. Thus, the flux lines extend through the wall of the retort and into the central passage where it acts directly upon the heated shot which is above the Curie Point and non-magnetic. The non-magnetic, heated condition of the shot prevents any appreciable motor action between the shot and flux field which could propel the shot forceably from the retort. The rolling action of the shot enhances the conduction and radiation heating between the internal cylindrical surface forming the second heating zone and the shot itself by increasing the amount of surface contact with the retort and by exposing most of the particles directly to the heating action. In this manner, the inner particles of the mass of shot progressing through the second zone are heated by direct action instead of particle-to-particle conduction. The agitated shot in the second zone will not tend to ball together and form masses of shot which are difficult to heat by conduction and radiation. Thus, in the second zone the flux extending through the retort allows agitation and enhances the efficiency of the heating operation without the motor action which could be created if the shot were below the Curie Point temperature, as experienced in the first heating zone.

To assure that the flux field does not extend into the first heating zone when a non-magnetic steel retort is used, it is possible to provide a separate internal layer of highly permeable material on the cylindrical surface of the retort in the first heating zone. This may be in the form of a sleeve in heat conductive relationship with the inner surface of the retort in the first heating zone. If the Curie Point temperature of the shot is not reached in the first heating zone, it is possible to extend this highly magnetic sleeve into a portion of the second zone to assure that the shot is beyond the Curie Point temperature before it is subjected to the flux field extending into the retort through the non-magnetic wall. In summary, in the first heating zone the Curie Point temperature of the shot is not surpassed. In the second zone, the shot is beyond its Curie Point temperature, which is substantially similar to the Curie Point of the retort material. In the second heating zone there is a gradual agitation as the retort is being rotated so that the shot is spread out on the surface of the retort to a greater extent and the efficiency of the conduction and radiation phenomenon is increased. The flux field does not hinder this agitation because of the non-magnetic condition of the shot.

In accordance with another aspect of the present invention, there is provided a method of heating ferromagnetic shot to a selected temperature substantially above the Curie Point temperature of the metal forming the shot. This method comprises passing the shot axially through a central passage of an elongated retort having first and second heating zones, inductively heating the retort adjacent the first zone by flux concentrated primarily in the retort, and inductively heating the retort adjacent the second zone by flux extending through the retort and into the central passage. The adgvantages of this method are the same as the advantages of the apparatus previously described. If the retort is formed from non-magnetic metal, a magnetic sleeve may be used to concentrate the flux in the first zone.

By using the present invention, the efficiency of heating the metal shot is substantially increased and the advantages of induction heating are realized without disadvantages which would be anticipated. After the shot has been heated by the apparatus and method defined above, it is then conveyed into the third heating zone of the same retort or into a second retort, either of which is inductively heated and includes a single zone to raise the temperature of the shot to above about 1600° F and preferably between 1900°-2000° F. In this second retort, a decarburizing atmosphere is circulated in a parallel or, preferably, a counter-flow method while the retort is being rotated. In this manner, by controlling the resident time, heated shot is decarburized. The resident time in the second retort is sufficiently long to reduce the carbon content of the shot, especially adjacent the surface thereof. Thereafter, the shot is cooled by a further rotating retort which, in accordance with another aspect of the invention, is used to preheat metallic abrasives or shot before passing it into the dual zone retort. To accomplish this preheating operation, the cooling device is a rotating drum having an inner cylindrical surface and an outer cylindrical surface, the heated shot is conveyed through the retort and in contact with the inner cylindrical surface. This heats the retort and heat energy passes through the retort wall to the outer cylindrical surface and propelling vanes. The incoming shot is then conveyed in close proximity to or in contact with the heated surface and vanes of the cooling chamber, which raises the temperature of the shot prior to introducing the shot into the dual zone retort. In practice, the shot is raised to a temperature of approximately 900° F while the shot being cooled is reduced to approximately 200° F by the rotating cooling drum. With this temperature differential, the heated shot coming into the cooling drum is above 900° F and the inlet end of the drum is at an elevated temperature. The dual zone retort must raise the temperature of the shot only from approximately 900° F to approximately 1500°-1600° F before it is finally heated and decarburized by the second rotating retort.

As can be seen, the shot heating operation is by induction heating; however, the shot itself is not heated by induction heating. In fact, it is heated by conduction and radiation from the inner surface of the rotating retort which is, in turn, heated by induction. Thus, low frequency can be used and the tendency of the small shot to be formed into balls or propelled from the retorts is minimized.

The primary object of the present invention is the provision of an apparatus and method for heating metallic abrasives or shots, which apparatus and method use induction heating and are efficient in operation.

Another object of the present invention is the provision of an apparatus and method for heating metallic abrasives or shot, which apparatus and method uses induction heating and heats the particles without propelling them and causing them to ball into a mass which is difficult to heat.

Still a further object of the present invention is the provision of a method and apparatus as defined above, which is not complex in structure, is easy to operate, is economical to build, uses no natural gas, has no noxious exhaust, is quite compact, and does not require substantial insulation.

These and other objects and advantages will become apparent from the following description taken together with the accompanying drawings in which:

FIG. 1 is a schematic plan view illustrating the preferred embodiment of the invention;

FIG. 2 is an enlarged, schematic, side elevational, and cross-sectional view taken generally along line 2—2 of FIG. 1;

FIG. 3 is a cross-sectional view taken generally along line 3—3 of FIG. 2;

FIG. 4 is a schematic, side-elevational, and enlarged cross-sectional view taken generally along line 4—4 of FIG. 1.

Figure 5:
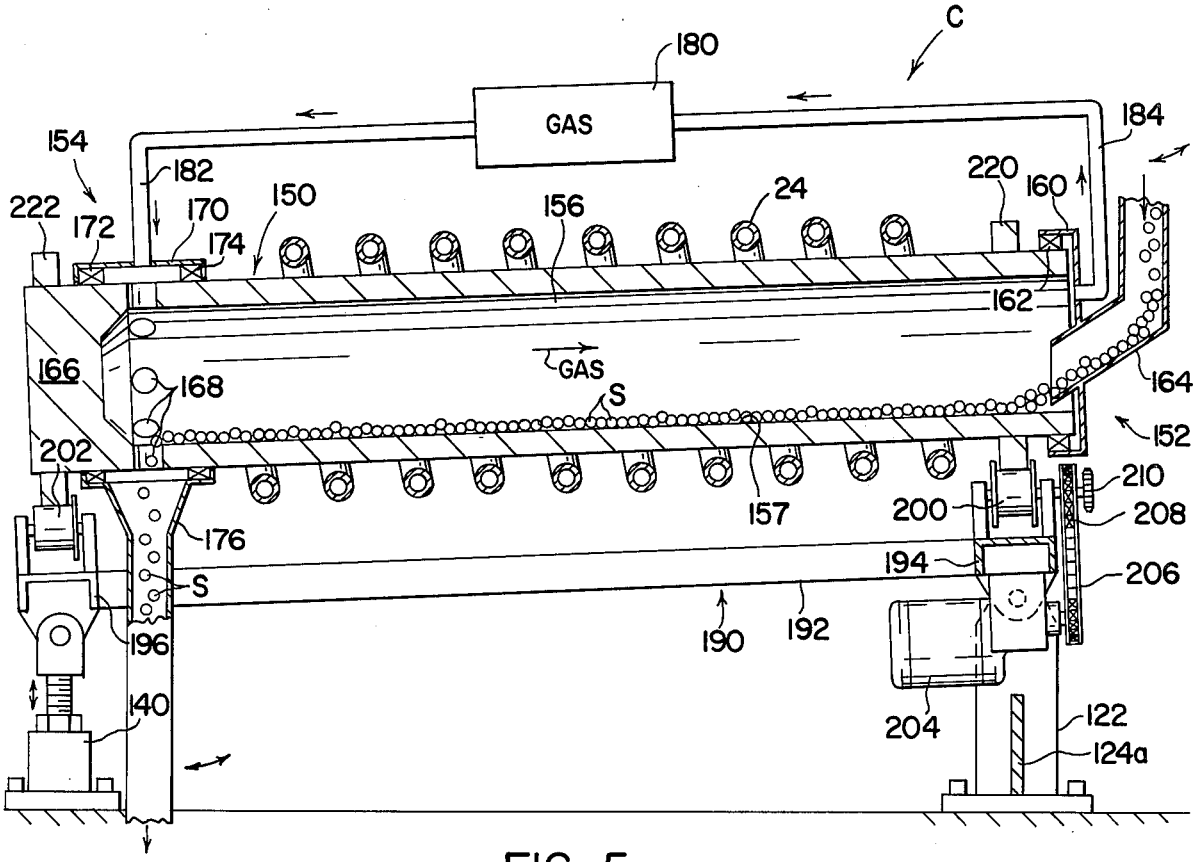
FIG. 5 is a schematic, side-elevational, and enlarged cross-sectional view taken generally along line 5—5 of FIG. 1.

Referring now to the drawings wherein the showings are for the purpose of illustrating a preferred embodiment of the invention only, and not for the purpose of limiting same, FIG. 1 shows a system A for decarburizing abrasive shot S. The shot is shown in the drawings as discrete particles; however, since the shot is generally approximately one-sixteenth inch across its major axis, the shot is actually a somewhat fluid movable mass of small metal particles. Although certain variations can be made in the composition of the particles a somewhat standard abrasive shot as a composition as follows:

| | |
|---|---|
| Carbon | 0.5 - 1.5 |
| Silicon | 1.1- 1.8 |
| Manganese | 0.4 - 0.6 |
| Phosphorous | 0.08 - 0.12 |
| Sulfur | 0.1 - 0.13 |
| Iron | Remainder |

This shot has a hardness, after processing, in the general range of 325-450 Vickers Pyramid Number. During processing in the system A, the carbon content of the shot is reduced from the normal 2.8 to 3.2% to the 0.5-1.5%, as set forth in the above example. The desirability of decarburizing abrasive shot is well known in the art and the present invention relates to the system A for decarburizing the shot while using primarily induction heating techniques. The system includes a primary heating unit B, best shown in FIGS. 2 and 3, a decarburizing unit C, best shown in FIG. 5, a combined cooling and preheating unit D, best shown in FIG. 4, and a power supply E for producing three phase 60 hertz alternating current to the heating units B and C. The power supply E may take a variety of forms; however, in accordance with the illustrated embodiment, three separate isolated phase windings 10, 12, 14 of a delta transformer secondary are individually used for energizing generally stationary multi-turn, water cooled inductors 20, 22, 24. Inductors 20, 22 are used as the induction heating devices for the primary heating unit B. In a similar manner, inductor 24 is used as the heating arrangement for the decarburizing unit C. Inductors 20, 22, 24 are separate phases of a three phase system which are balanced to produce an approximate unitary power factor for power supply E. Schematically represented conveyors F, G, H, J and K are used for conveying the mass of abrasive shot S between the various units shown in FIG. 1. These conveyors may take any desired construction to accomplish the task of conveying the shot between the units without excessive heat losses during the heating portion of the system and with sufficient cooling during the cooling portion of system A.

Referring now to the operation of system A, as best shown in FIG. 1, a supply of shot S at ambient temperature, i.e. approximately 100° F, is introduced through conveyor F into the preheat portion of the combined cooling and preheat unit D. After being preheated to approximately 900° F, in the illustrated example, the mass of shot S is conveyed along conveyor G to the entrant end of the primary heating unit B. This conveyor system is constructed to prevent substantial decrease in temperature of the shot as it is conveyed from the preheat portion of unit D to the entrant end of unit B. After passing through the unit D, the mass of shot S is heated to a temperature in the general range of 1500°-1600° F which exceeds the Curie Point temperature of the shot being processed. Conveyor H is used for conveying the heated mass of shot S from unit B to the decarburizing unit C. After being conveyed through the decarburizing unit C, where the mass of shot S is held for approximately 20 minutes at a temperature in the general range of 1900°-2000° F, the mass of shot S is conveyed by conveyor J to the cooling portion of combined unit B. Heat can be dissipated from the shot as it passes in conveyor J, since the decarburizing process has been completed in unit C. After passing through the cooling portion of combined unit D, the mass of shot S is discharged along an appropriate conveyor K at a low temperature, which in practice is approximately 200° F. The temperatures used in the illustrated embodiment of the invention, as shown in FIG. 1, are representative in nature and may be varied to accomplish the desired decarburizing function of system A. Basically, the primary heating unit B is used to raise the temperature of shot S to a high temperature which is maintained when the shot is discharged into the entrant end of the decarburizing unit C. Thus, a substantial reduction of temperature in conveyor H is not advantageous. It is desirable to convey shot from unit B to unit C with a minimum temperature decrease so that the shot may be quickly raised to the decarburizing temperature in decarburizing unit C and held there for a sufficient resident time to properly decarburize the steel forming the shot. As previously mentioned the shot is basically a fluid mass of fine particles, or a mixture of large and small particles, although the shot is shown as relatively large circular particles in the drawings for the purposes of illustrating the operating techniques employed on the total mass of particles being processed.

Referring now to the primary heating unit B, as best shown in FIGS. 2 and 3, this unit includes a generally cylindrical retort 30 which in one embodiment is formed from magnetic metal having a Curie Point temperature somewhat similar to the Curie Point temperature of the shot. This temperature is generally in the range of 1350°-1450° F. This retort is, in practice, formed from a sheet metal non-magnetic material, such as non-magnetic stainless steel. Other non-magnetic materials could be used. This retort includes an entrant end 32, an exit end 34, and a central passage 36 generally concentric with an elongated axis *a.* Retort 30 is divided into a first heating zone I and a second heating zone II. Zone I is surrounded by an inner cylindrical surface portion 40 and zone II is surrounded by a similar cylindrical surface portion 42. These surface portions, in practice, are generally the inner surface of the sheet metal forming retort 30. If the sheet metal forming the retort is non-magnetic, such as non-magnetic stainless steel, a highly permeable tube or layer 44 is positioned on the surface portion 40 in zone I to provide a flux barrier at surface 40. This highly permeable material may extend into a small portion of the second heating zone II. Retort 30 has an inlet 50 which introduces shot from conveyor G into inner passage 36 of the retort. This inlet may take a variety of forms; however, in the preferred embodiment of the invention, a plate 52, having a sliding, cylindrical seal 54 surrounding retort 30, receives a feeding chute or nozzle 56 from hopper 60 which is fed by conveyor G. The outlet 70 of retort 30 includes a cap 72 and has a plurality of circumferentially spaced outlet apertures 74. These apertures are aligned with a lower escapement plate 80 having an opening 82 through which the shot S falls by gravity into an exit duct 84. This duct directs the shot to conveyor H for immediate introduction into the decarburizing unit C.

During the heating operation, retort 30 is rotated about its elongated axis *a* by an appropriate mechanism which may take the form of an I-frame 90 having a central beam 92, a front cross-arm 94 and a rear cross-arm 96. A pair of front transversely spaced, rimmed rollers 100 and a pair of similar rear rimmed rollers 102 cooperate with a front ring 104 and a rear ring 106 to rotatably support retort 30 for rotation about its elongated axis. A motor 110 supported on the lower portion of beam 92 is used to drive a chain 112, which rotates a sprocket 114 secured to the outer surface of retort 30 between the first heating zone I and the second heating zone II. The inductors 20, 22, are generally stationary and motor 110 rotates retort 30 within these multi-turn inductors for the heating of the retort by induction.

Shot S in the form of a moving mass is conveyed through retort 30 by an appropriate arrangement, schematically illustrated as a means for tilting retort 30 with respect to a horizontal position and with the rear end being lower than the front end, in most circumstances. However, the rear end could be higher than the front end to increase shot resident time since the mass of shot S would ultimately reach a high level corresponding with outlet apertures 74 and be conveyed through these apertures. To provide the tilting action, a variety of structures could be used; however, in accordance with the illustrated embodiment, there is provided a pivot connection at the entrant end of retort 30 which is formed by spaced trunnion support bars 120, 122 separated by a support plate 124 and depending trunnion blocks 126, 128. The bars and blocks are connected, respectively, by two pins 130, 132 so that retort 30 can be selectively tilted about pins 130, 132. At the rear end of retort 30, a jack 140 is connected to upper trunnions 142 for raising and lowering the rear end of retort 30. Of course, inductors 20, 22 should move with the retort and can be supported on the I-frame 90.

In operation, as a large mass of metal shot goes through nozzle 56 into the central passage 36 of retort 30, motor 110 rotates the retort. A low frequency alternating current is passed through inductor 20. Since the shot is at approximately 900° F, the shot is still magnetic in character and below its Curie Point temperature while being heated in first zone I. This zone has an outlet temperature which is only slightly lower than the Curie Point temperature of the shot being heated. The temperature of the zone is approximately 1150° F and the exit temperature of the shot is approximately 1150° F. When retort 30 is formed from a magnetic material, the flux field created by alternating current circulating through inductor 20 is concentrated within the wall of retort 30 since this wall has not been heated to its Curie Point temperature which is in the general range of 1400° F. Thus, the metal adjacent cylindrical surface 40 is not heated to a sufficiently high temperature by the surrounding inductor 20 to become non-magnetic. The magnetic characteristic of the retort in zone I concentrates the flux field of the inductor in the wall of the retort and does not allow the flux field to extend into the zone I to act upon shot S, while it is in its magnetic condition. Thus, in zone I the flux of the inductor is concentrated within the wall of the retort. To concentrate the flux and prevent any substantially magnetic field which can act upon shot in zone I when the retort is formed from non-magnetic metal, the ferromagnetic layer or sleeve 44 is used. In this illustrated embodiment, this layer or sleeve is inlaid into retort 30 adjacent the first heating zone. To assure that the surface 40 remains non-magnetic until the shot has passed from zone I to zone II where it is heated above its Curie Point temperature, layer or sleeve 44 can extend slightly into the entrant portion of zone II. This is shown in the left end of sleeve 44 in FIG. 2. Thus, in zone I, the shot is magnetic and is heated to a temperature lower than, but near, its Curie Point temperature. When moved into the second zone II and after passing from sleeve 44, the shot is immediately heated above its Curie Point temperature. In the second zone, inductor 22 heats the wall of the retort to a temperature substantially above the Curie Point temperature of shot S. In doing this, the retort in zone II is itself heated above its Curie Point temperature. Thus, the magnetic flux lines from inductor 22 extend into passage 36 in zone II. These flux lines do not affect the non-magnetic heated shot S, which is generally in a large flowable mass and allow agitation of the particles along surface 42 as the retort is being rotated. In this manner, a larger portion of the heated surface 42 is used for conduction heating of the metal shot within zone II. Since the flux field of inductor 20 of zone I does not extend into passage 36, the flux lines cannot act upon the magnetic shot S in the first heating zone I. If flux lines extend through the retort wall into the passage before a majority of the shot is above the Curie Point temperature, a magnetomotive force could be created due to the low frequency alternating current used to heat the walls of rotating retort 30.

Low frequency, as used in the preferred embodiment, allows efficient heating of the retort walls. In practice, the frequency is 50 hertz or 60 hertz when the retort has an outside diameter of 24 inches and a thickness of 0.5 inches. In some instances different frequencies may be used from about 30 hertz to 1000 hertz. Basically, as the size of the retort and walls increase, a lower frequency may be used. As these dimensions are reduced, higher frequency up to about 1000 hertz may be effectively employed. To prevent the resulting motive force, which can be created between a low frequency and small magnetic particles, the entrant end, or zone I, of retort 30 is retained at a temperature which maintains the magnetic characteristics of the retort or sleeve. This prevents the magnetic flux field from extending into passage 36 and acting upon the magnetic shot. After heating the shot to the Curie Point temperature which occurs near the exit end of zone I, the magnetic flux will have no substantial magnetomotive effect upon shot S, since the shot will then be above the Curie Point temperature and will be non-magnetic. Thus, in the second portion of retort 30, the low frequency alternating current heats the wall of retort 30 to a temperature above its Curie Point temperature when the retort is formed from a magnetic metal. The wall is non-magnetic, even if magnetic metal is used, and allows flow of the flux field to extend into passage 36. This flux field does not prevent smooth agitation of the large mass of heated shot S in zone II as the retort rotates. This agitation, as previously described, enhances the heating efficiency of the shot in the second zone of retort 30.

In summary, retort 30 may be formed from a magnetic metal or a non-magnetic metal with a magnetic sleeve in the first zone. The retort includes two separate heating zones. In the first zone, the temperature of the wall of retort 30 does not exceed the Curie Point temperature of the wall when the wall is magnetic or of sleeve 44 when the wall is non-magnetic. Thus, the wall remains magnetic and the flux field cannot enter passage 36 and coact with the shot before the shot becomes non-magnetic. In zone II, the wall of retort 30 is heated beyond the Curie Point temperature of both the wall and the metal shot. Thus, the shot is heated above its Curie Point temperature by the heated retort. To provide these two separate temperatures, the incoming shot has some effect. The cool shot coming into zone I has a tendency to withdraw heat energy from surface 40 during its progress through zone I. This has a tendency to equalize the temperature of surface 40 at a temperature below the Curie Point temperature of the metal forming retort 30 or of sleeve 44. Since the inductors 20, 22 are separate inductors, they can be independently controlled or spaced differently from retort 30 to produce a higher heated temperature in zone II. The general operation of retort 30 in zones I, II can be varied slightly without departing from the major operating characteristics of the primary heating unit B. For instance, the Curie Point temperature in zone I may be exceeded at the rear end of the zone. In addition, the Curie Point temperature in zone II for the shot may not be reached until slightly into the zone. These are minor variations over the general operating scheme of the preferred embodiment of the invention as illustrated in FIGS. 2 and 3.

Referring now to the decarburizing unit C, this unit includes, as the heating device, inductor 24 which is generally fixed with respect to a cylindrical retort 150 formed from a non-magnetic, inductively heatable sheet metal, such as non-magnetic stainless steel. Of course, it is conceivable that a magnetic material could be used for the retort 150 since the retort is substantially above 1600° F, which would render such magnetic material non-magnetic in nature. Retort 150 includes an entrant end 152, and an exit end 154 and a central passage 156 having an internal cylindrical surface 157. The inductor 24 raises the temperature of retort 150 so that the inner surface 157 is at a high temperature sufficient for decarburizing shot S as it is conveyed through passage 156. End plate 160 at entrant end 152 is generally stationary and includes a circumferential seal 162 between the rotating retort 150 and the end plate. A generally stationary feed chute 164 directs the mass of shot S from conveyor H into central passage 156 where it is heated by conduction and radiation of heat from cylindrical surface 157. At the opposite end of retort 150, there is provided closing end wall 166 and a plurality of apertures 168 which discharge shot S into an exit chamber 170, which is generally stationary with respect to the retort. Axially spaced, circumferentially extending seals 172, 174 form a gas tight seal between chamber 170 and retort 150. A lower outlet chute 176 collects shot discharged from the lowermost aperture 168 and directs shot to conveyor J, as shown in FIG. 1. As in FIGS. 2 and 3, the structure shown in FIG. 1 is a vertical section so that gravity feeds shot through chute 176. A supply of decarburizing gas is contained within gas supply 180, which also includes an appropriate fan or pump to pump decarburizing gas through a generally closed circuit including inlet pipe 182 and outlet pipe 184. Thus, gas is conveyed in a counter-flow direction though passage 156 for action with shot S as it is being held at an elevated temperature in the rotating retort. Resident time is controlled by the rate at which shot S is conveyed through chamber 156 and this time is, in the preferred embodiment, approximately 20 minutes. During this time, the mass of shot is heated by wall 157 and agitated by the flux field extending through the retort wall and into passage 156.

Any appropriate arrangement could be used for rotating retort 150. In accordance with the illustrated embodiment, an I-frame 190 is constructed similar to I-frame 90, shown in FIGS. 2 and 3. An axially extending beam 192 supports a front cross-arm 194 and a rear cross-arm 196. Rimmed rollers 200, 202 rotatably support retort 150 for rotation with respect to inductor 24. Rollers 200 are driven by motor 204 through a chain 206 extending from the motor to sprocket 208 on one of the roller 200. The other roller is connected by an interconnecting sprocket arrangement represented by sprocket 210 concentric with sprocket 208 and driven by the same shaft. This sprocket 210 drives the other roller 200 in the same direction as the first roller to rotate retort 150 on support rings 220, 222.

Shot S in a large mass is conveyed through passage 156 at a controlled rate to determine the desired resident time. A variety of conveying means could be used; however, in the illustrated embodiment of the invention, a tilting arrangement is provided similar to that used on retort 30, shown in FIGS. 2 and 3. Like parts in FIG. 5 are designated with the same numbers as parts in FIGS. 2 and 3. The basic difference is that support plate **124*a* is vertically shorter than plate 124 shown in FIG. 2 to allow clearance for drive motor 204. The extent to which jack 140 tilts retort 150 determines the speed at which the shot is conveyed through the retort. It is conceivable that the rear or exit end of the retort can be higher than the entrant end. In this manner, the resident time of the shot is increased. The shot is in a flowable mass which flows somewhat like a liquid through the various retorts. When the rear end of the retort is high, the level of the mass of shot will rise to the outlet apertures 168. In this manner, increased resident time is provided without decreasing the rotational speed of the retort, which is designed for efficient heating of the shot in the retort. Magnetic flux lines extend through retort 150 and agitate the shot as it is being rotated. This causes better contact of the shot with surface 157 and increases agitation of the shot for more efficient heating by conduction and radiation. This agitation also enhances the surface coaction between the decarburizing gas and shot S within passage 156**.

Referring now more particularly to the combined cooling and preheating unit D, this unit is best shown in FIG. 4 and includes a cooling drum 230 formed from a heat conductive material, such as sheet metal. The drum is mounted for rotation about a central axis which is tilted with respect to the horizontal plane and includes closed ends 232, 234 and an inner cylindrical surface 236. An outer cylindrical surface 238 is in heat conductive relationship with inner surface 236 and conducts heat from shot S to the outer surface. Drum 230 is rotated on rimmed rollers 240, 242 by rings 244, 246. A motor 250 drives the drum in a direction indicated by the arrow through chain 252. Inlet trough 260 directs the heated mass of shot S through a conical inlet opening 262 located basically at the rotational axis of drum 230. Exit apertures 270 deposit cooled shot, at about 200° F, into outlet chute 272 located below the lower and rear end of drum 230, as shown in FIG. 4. Thus, shot S is cooled as it moves through drum 230. Of course, it is possible to use a cooled circulating gas for further reducing the temperature of shot S. In the preferred embodiment, the shot is cooled by incoming shot from conveyor F. The incoming shot on conveyor F is preheated by an appropriate preheat mechanism 280 which includes a semi-circular trough 282 having an inner cylindrical surface 284 generally concentric with outer cylindrical surface 238 of drum 230. These two surfaces define an annular passage 290 which receives a spiral blade 292 supported onto, and driven with, drum 230. The blade has a radial height substantially corresponding to the spacing between surfaces 238, 284 so that shot within passage 290 is conveyed from right to left as shown in FIG. 4. Shot is introduced into passage 290 by a chamber 300, which is generally stationary and has an opening 302 for drum 230. An inlet hopper 304 receives shot from conveyor F which shot is at ambient temperature, i.e. approximately 100° F. During the preheating operation, the incoming shot is preheated to a temperature of approximately 900° F and exits from the unit D by the outlet chute 306 which conveys the preheated shot along conveyor G to the inlet of unit B, as previously described.

As previously mentioned, inductors 20, 22 and 24 are energized at a low frequency alternating current, preferably 60 hertz. Each of the inductors forms a separate phase in a three phase power supply which is electrically balanced. In practice, zone I heats shot to approximately 1150°. Zone II heats the shot through the Curie Point temperature to approximately 1550°-1600° F. In unit C, inductor 24 heats the shot to a temperature sufficient for decarburization. In practice, this is approximately 1900°-2000° F; however, it may be as high as approximately 2200° F. In a typical system A, four thousand pounds of shot are processed per hour and each inductor is rated at approximately 200 kilowatts. In the drawings, the shiftable retorts coact with inlet and outlet chutes or troughs which may shift with the retorts as they are adjusted. This action is indicated by the arcuate arrows adjacent the inlet and outlet conveying means.

In practice, retorts 30 and 150 are formed from non-magnetic stainless steel with an outside diameter of 24 inches and a wall thickness of 0.5 inches. It has been found that the ratio of wall thickness and outside diameter has a marked effect upon the efficiency of heating with a low frequency, such as 60 hertz. For high electrical heating efficiency, the wall thickness should be between about 1-10 percent of the outside diameter. In practice the wall thickness is just above 2 percent of the outside diameter. Also the ratio of the outside diameter to $\sqrt{2}$ times the reference depth of heating for the heating frequency should be greater than about 5 and generally in the range of 6-10 when the wall is non-magnetic. The non-magnetic condition can be realized by heating a magnetic wall over the Curie Point temperature or by using a non-magnetic metal for the wall. This ratio, in practice with 60 hertz, is 6.05. This ratio, when the wall is formed from magnetic material and not above the Curie Point temperature is about 47. By using the dimension of the preferred embodiment, the efficiency of heating in zone I is greater than 95 percent and in zone II is greater than 85 percent. These are efficiencies not expected in this type of heating operation and result from the proper selection of the relationship between outside diameter and wall thickness.

In system A, a given flow rate for the shot is established. By using a separate retort 150, the resident time can be increased while maintaining the desired flow rate. In practice, retort 150 is tilted with end 154 vertically higher than end 152. Consequently, a flowable mass is created which is larger at the entrant end 152 and smaller at the exit end 154. In this type of mass, the shot in the entrant end is moving at a lower effective longitudinal velocity than shot adjacent the exit end. Since coil 24 surrounds the total mass, the shot is heated to the decarburizing temperature near the entrant end while the shot is moving quite slowly. Thus, the decarburizing temperature is quickly obtained and continues for the total time in retort 150. This beneficial feature could not be obtained by placing the third coil or inductor 24 on the exit end of retort 30. If this were done, the third coil would act only upon rapidly moving shot and would not produce the desired resident time for carburizing.

Having thus described the invention, it is claimed:

1. An apparatus for heating ferromagnetic shot to a selected temperature substantially above the Curie Point temperature of the metal forming said shot, said apparatus comprising: an elongated, generally cylindrical retort having a central axis and a central passage; said retort being divided into first and second axially spaced heating zones and each of said zones being surrounded by first and second generally cylindrical surface portions, respectively of said central passage, said first surface being formed from a magnetically permeable material having a Curie Point temperature, first inductor means for inductively heating said retort adjacent said first heating zone to a first average temperature below said Curie Point temperatures of said shot and of said retort; second inductor means for inductively heating said retort adjacent said second heating zone to a second average temperature substantially above said Curie Point temperatures of said shot and said retort; means for conveying said shot successively through said first zone and then through said second heating zone whereby said shot is first heated by said first surface to a temperature below the Curie Point temperature thereof in said first heating zone and is then heated substantially by induction heating to said selected temperature in said second heating zone; and means for rotating said retort about said central axis.

2. An apparatus as defined in claim 1 wherein said first and second inductor means are each eneergized by an alternating current having a frequency of approximately 60 hertz.

3. An apparatus as defined in claim 1 including a flux concentrating tubular means formed from said high magnetic permeability material and forming said first generally cylindrical surface portion of said retort.

4. An apparatus as defined in claim 3 wherein said flux concentrating means extends into only a portion of said second heating zone.

5. An apparaus as defined in claim 1 wherein said first generally cylindrical surface portion of said retort includes a layer of high magnetically permeable material.

6. An apparatus as defined in claim 5 wherein said layer extends into only a portion of said second heating zone.

7. An apparatus for heating ferromagnetic shot to a selected temperature substantially above the Curie Point temperature of the metal forming said shot, said apparatus comprising: an elongated, generally cylindrical retort having a central axis, and a central passage and being formed from a magnetically permeable material having a Curie Point temperature; said retort being divided into first and second axially spaced heating zones and each of said zones being surrounded by first and second generally cylindrical surface portions, respectively, of said central passage; first inductor means for inductively heating said first generally cylindrical surface portion to a temperature below said Curie Point temperature of said retort material whereby a major portion of the magnetic flux from said first inductor means is concentrated in said retort; second inductor means for inductively heating said second generally cylindrical surface portion to a temperature substantially above said Curie Point temperature of said retort material whereby a major portion of the flux from said second inductor means extends through said retort into said passage; means for conveying said shot successively through said first zone and then through said second heating zone; and means for rotating said retort.

8. A method of heating ferromagnetic shot to a selected temperature substantially above the Curie Point temperature of the metal forming said shot, said method comprising the steps of:

a. passing said shot axially through a central passage of an elongated retort having first and second heating zones;

b. inductively heating said retort adjacent said first zone by flux concentrated primarily in said retort; and, c. inductively heating said shot adjacent said second zone by flux extending through said retort and into said central passage.

9. A method as defined in claim 8 wherein said induction heating steps are performed by low frequency alternating current.

10. A method as defined in claim 9 wherein said low frequency alternating current has a frequency of about 60 hertz.

11. An apparatus for heating ferromagnetic shot to a selected temperature substantially above the Curie Point temperature of the metal forming said shot, said apparatus comprising: an elongated, generally cylindrical retort having an outside diameter, a given wall thickness, a reference depth when exposed to an alternating current having a given frequency, a central axis and a central passage; said retort being divided into first and second axially spaced heating zones and each of said zones being surrounded by first and second generally cylindrical surface portions, respectively of said central passage, first inductor means for inductively heating said retort adjacent said first heating zone to a first average temperature below said Curie Point temperature of said shot; second inductor means for inductively heating said retort adjacent said second heating zone to a second average temperature substantially above said Curie Point temperature of said shot; means for conveying said shot successively through said first zone and then through said second heating zone whereby said shot is first heated to a temperature below the Curie Point temperature thereof in said first heating zone and is then heated to said selected temperature in said second heating zone; means for rotating said retort about said central axis; and means for preventing substantial flux fields in said first heating zone, when the ratio of said diameter to approximately $\sqrt{2}$ times said reference depth is greater than 5.

12. An apparatus as defined in claim 11 wherein said ratio is in the general range of about 5–10 when said retort is formed from a non-magnetic metal.

13. An apparatus as defined in claim 11 wherein said wall thickness is less than about 10 percent of said diameter.

14. An apparatus as defined in claim 13 wherein said wall thickness is between about 1–10 percent of said diameter.

15. An apparatus as defined in claim 11 wherein said retort is formed from a non-magnetic metal and including an inner layer of high magnetic permeable metal adjacent said first generally cylindrical surface to prevent a flux field from said first inductor means from extending into said first zone.

* * * * *